US006579349B1

(12) United States Patent
Ting et al.

(10) Patent No.: US 6,579,349 B1
(45) Date of Patent: Jun. 17, 2003

(54) ELECTROSTATIC PRECIPITATOR

(76) Inventors: Chein-Bang Ting, No. 26, Lane 37, Sec. 4, Chungyang Rd., Tucheng City, Taipei Hsien (TW); Min-Yi Chu, No. 26, Lane 37, Sec. 4, Chungyang Rd., Tucheng City, Taipei Hsien (TW)

( * ) Notice: Subject to any disclaimer, the term of this patent is extended or adjusted under 35 U.S.C. 154(b) by 0 days.

(21) Appl. No.: 10/118,441

(22) Filed: Apr. 8, 2002

(51) Int. Cl.[7] ..... B03C 3/16

(52) U.S. Cl. ..... 96/44; 55/DIG. 38; 96/49; 96/53; 96/73; 96/83; 96/90; 96/96; 96/100

(58) Field of Search ..... 96/96, 83, 90, 96/91, 100, 73, 44, 53, 49, 50; 55/DIG. 38

(56) References Cited

U.S. PATENT DOCUMENTS 1,393,712 A * 10/1921 Steere et al. ..... 95/73
1,908,897 A * 5/1933 Heinrich ..... 96/29
1,944,523 A * 1/1934 Miller ..... 95/72
1,997,729 A * 4/1935 Herber ..... 96/91
2,055,368 A * 3/1936 Shively ..... 204/170
2,592,508 A * 4/1952 Phyl ..... 96/98
2,730,195 A * 1/1956 Roberts ..... 95/59
3,765,154 A * 10/1973 Hardt et al. ..... 96/88
4,077,785 A * 3/1978 Hartshorn ..... 96/99
4,441,897 A * 4/1984 Young et al. ..... 96/36

* cited by examiner

*Primary Examiner*—Richard L. Chiesa
(74) *Attorney, Agent, or Firm*—William E. Pelton, Esq.

(57) ABSTRACT

An electrostatic precipitator includes an upright hollow body having a lower smoke inlet and an upper smoke outlet, with a pair of spaced horizontal partitions formed in the hollow body between the inlet and outlet. A set of parallel ducts extends vertically between the partitions, and a pair of distributor frames is arranged in the hollow body, with one of the distributor frames disposed over the ducts and the other of the distributor frames disposed under the ducts. Between the distributor frames is stretched a plurality of wires that extend through respective ducts. Furthermore, each of the distributor frames is formed with a plurality of terminals to be electrically connected to one electrode of a DC high-voltage power supply, but the ducts are adapted to be electrically connected to the other electrode of the DC high-voltage power supply.

8 Claims, 11 Drawing Sheets

ELECTROSTATIC PRECIPITATOR

BACKGROUND OF THE INVENTION

1. Field of the Invention

The present invention relates to an electrostatic precipitator and, more particularly, to an electrostatic precipitator of improved efficiency in purifying smoke.

2. Description of Related Art

Electrostatic precipitators are widely use to purify smoke by capturing particles suspended in the smoky air. As shown in FIGS. 9 and 10, such a conventional precipitator typically includes a horizontal hollow body having a smoke inlet (60) and a smoke outlet (61), with a motor (62) provided for driving a fan (not shown) within the outlet (61).

In the hollow body, there is a net (70) for filtering smoke and a pair of-frames (81) for receiving collecting boxes (80), which are supplied with DC high-voltage power from transformers (90).

As shown in FIG. 11, each of the boxes (80) is provided with a plurality of parallel collecting plates (84) defining passage for the smoke, and a plurality of wires (85) positioned between the plates (84). These wires (85) end in their terminals (82) that are electrically connected to the positive electrode of the transformers (90), while the plates (84) are electrically connected to the negative electrode of the transformers (90). As a result, the wires (85) serve as high-voltage anodes and the collecting plates (84) as cathodes.

When smoke passes through the box (80), some particles in the smoke probably impact the wires (85), i.e. the anodes, and are positively electrified. The electrified particles may then be captured by the negative plates (84) as they continue to travel through the passages, and so the smoke is purified, more or less.

It has been found, however, that the conventional electrostatic precipitator is not efficient in such purification, since the wires (85) are provided only at the entrance of the box rather than the full length of the passages. Furthermore, the horizontal hollow body coves an excessive area on the ground, and the boxes (80) have to be removed from the hollow body if it is necessary to clean them.

Therefore, it is an objective of the invention to provide an electrostatic precipitator to mitigate and/or obviate the aforementioned problems.

SUMMARY OF THE INVENTION

The object of the present invention is to provide an electrostatic precipitator which is efficient in purifying smoke.

Another object of the present invention is to provide an electrostatic precipitator which covers a reduced area on the ground.

Still another object of the present invention is to provide an electrostatic precipitator which can achieve self-cleaning.

Other objects, advantages and novel features of the invention will become more apparent from the following detailed description when taken in conjunction with the accompanying drawings.

DETAILED DESCRIPTION OF THE PREFERRED EMBODIMENT

Figure 1:
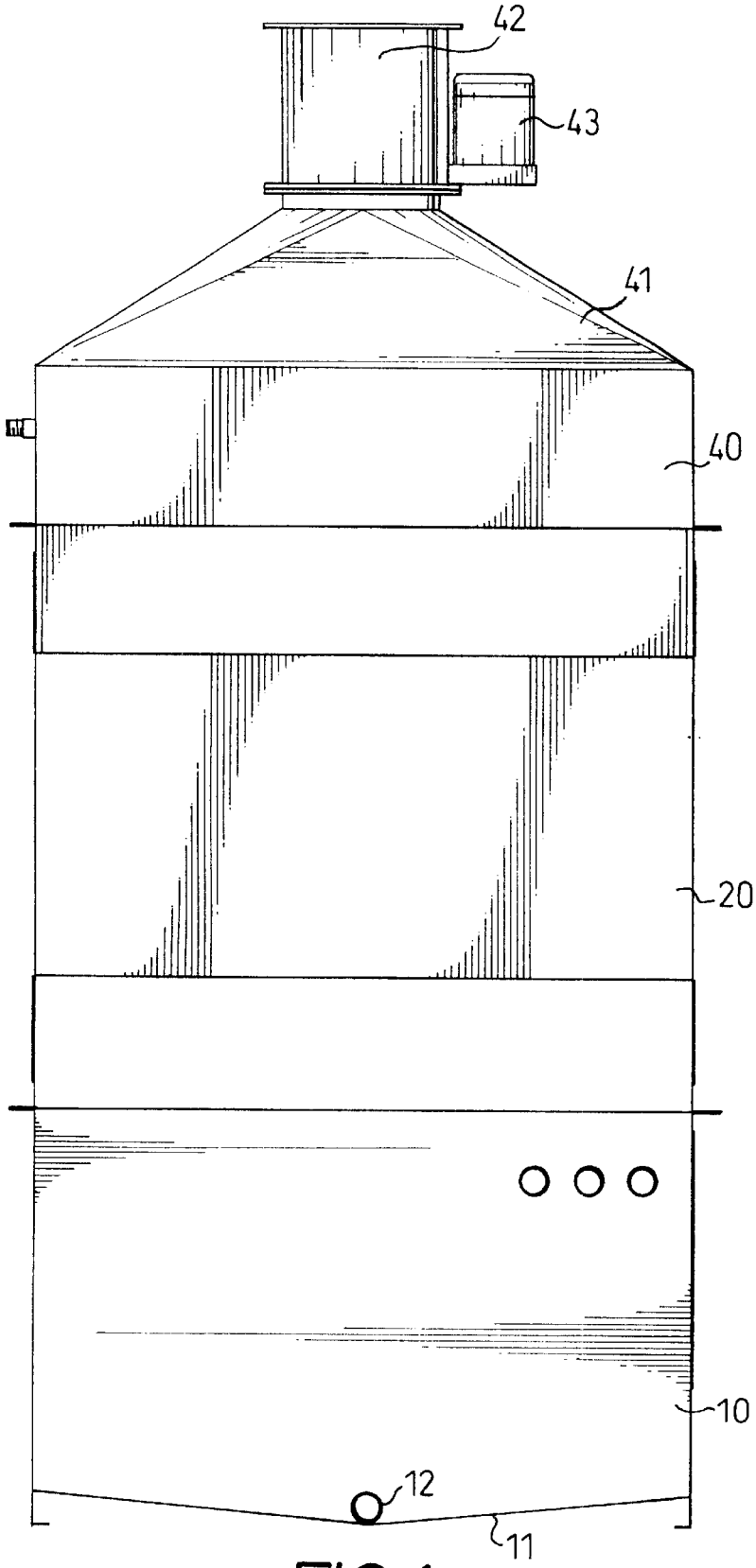
FIG. 1 is a front view of a preferred embodiment of an electrostatic precipitator in accordance with the present invention.
Figure 3:
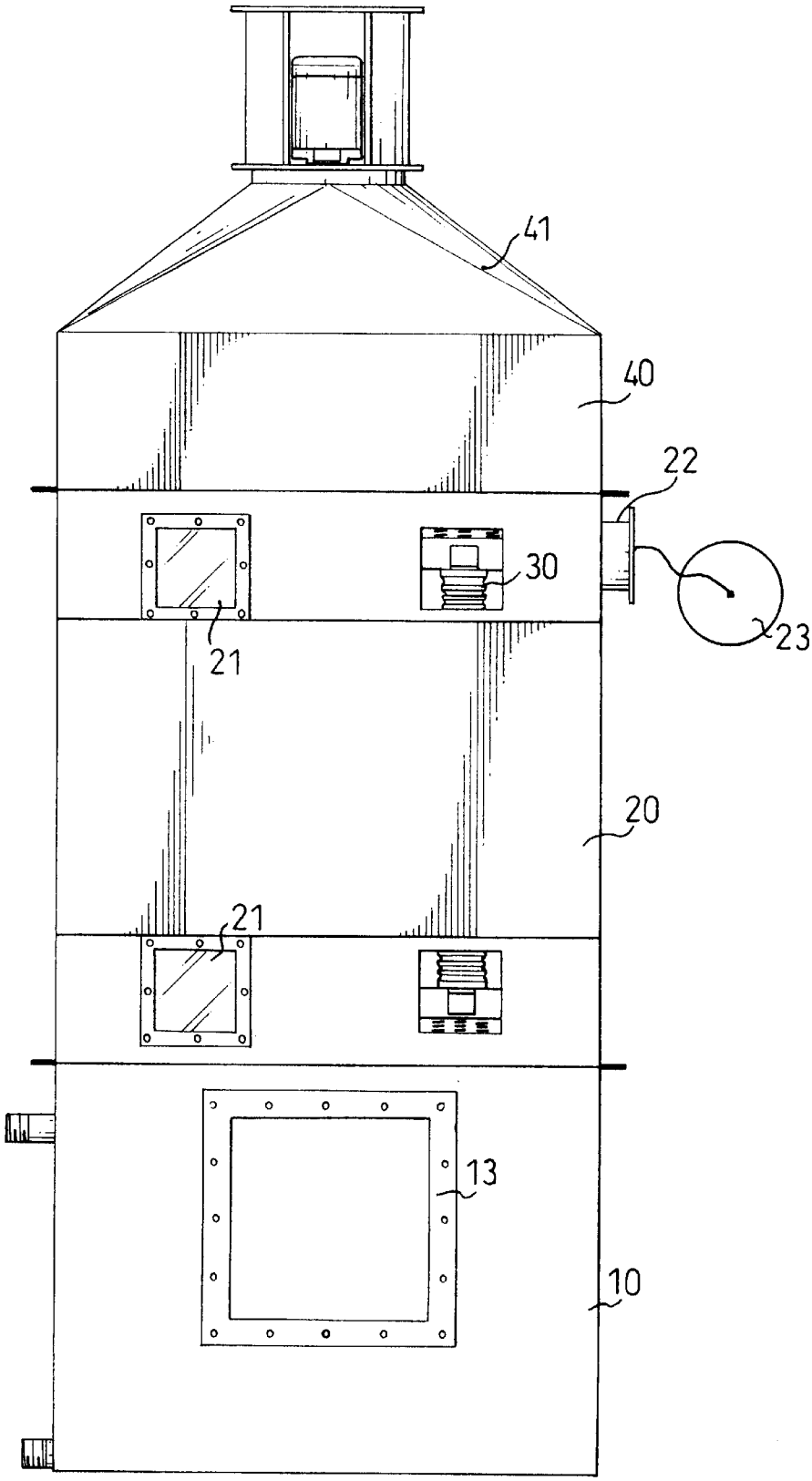
FIG. 3 is a right side view of the electrostatic precipitator of FIG. 1.

Referring to FIGS. 1 and 3, there is shown a preferred embodiment of an electrostatic precipitator in accordance with the present invention for removing waste particles, such as from smoke. The inventive precipitator includes an upright hollow body consisting of a base portion (10), a middle portion (20) and a top portion (40), each made of metal and collectively arranged in a stack.

Each of the base and middle portions (10, 20) has a rectangular transverse cross-section. The base portion (10) has a lower smoke inlet (13) defined in a side thereof, as shown in FIG. 3, for the entry of smoke into the hollow body. The top portion (40) has a tapered crown (41), terminating in an upper smoke outlet (42) for the discharge of purified smoke from the hollow body.

Preferably, the top portion (40) of the hollow body is formed with a motor (43) for driving an extractor fan (not shown), which is provided in the outlet (42).

Figure 2:
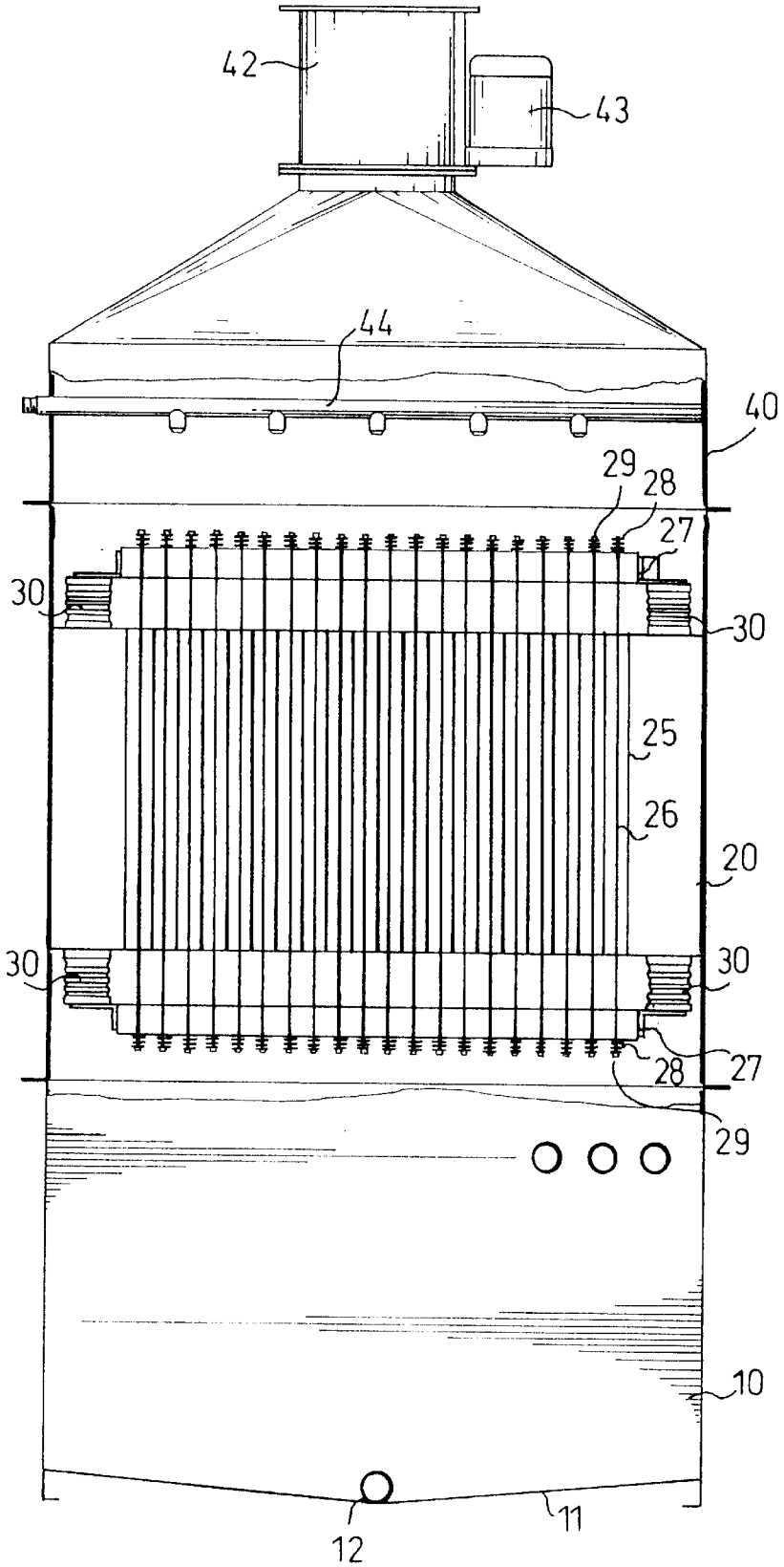
FIG. 2 is a front view, partially broken, of the electrostatic precipitator of FIG. 1.
Figure 4:
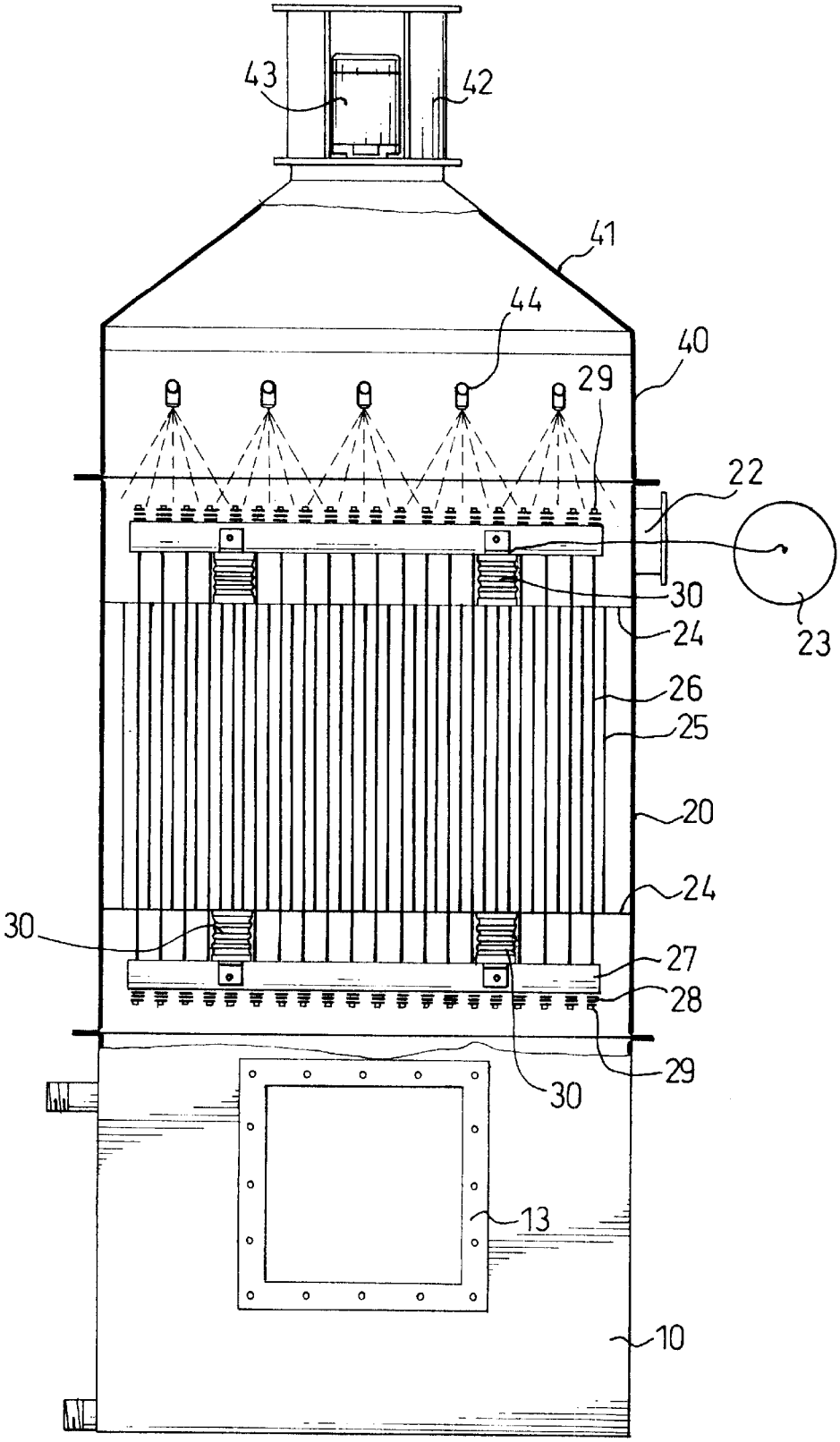
FIG. 4 is a right side view, partially broken, of the electrostatic precipitator of FIG. 1, showing the elements therein being cleaned.

Referring to FIGS. 2 and 4, the middle portion (20) has a pair of spaced horizontal partitions (24) formed therein between the smoke inlet (13) and outlet (42). The two partitions (24) divide the room within the hollow body into an upper space above them and a lower space below them, which are both to be filled with the smoke.

Figure 7:
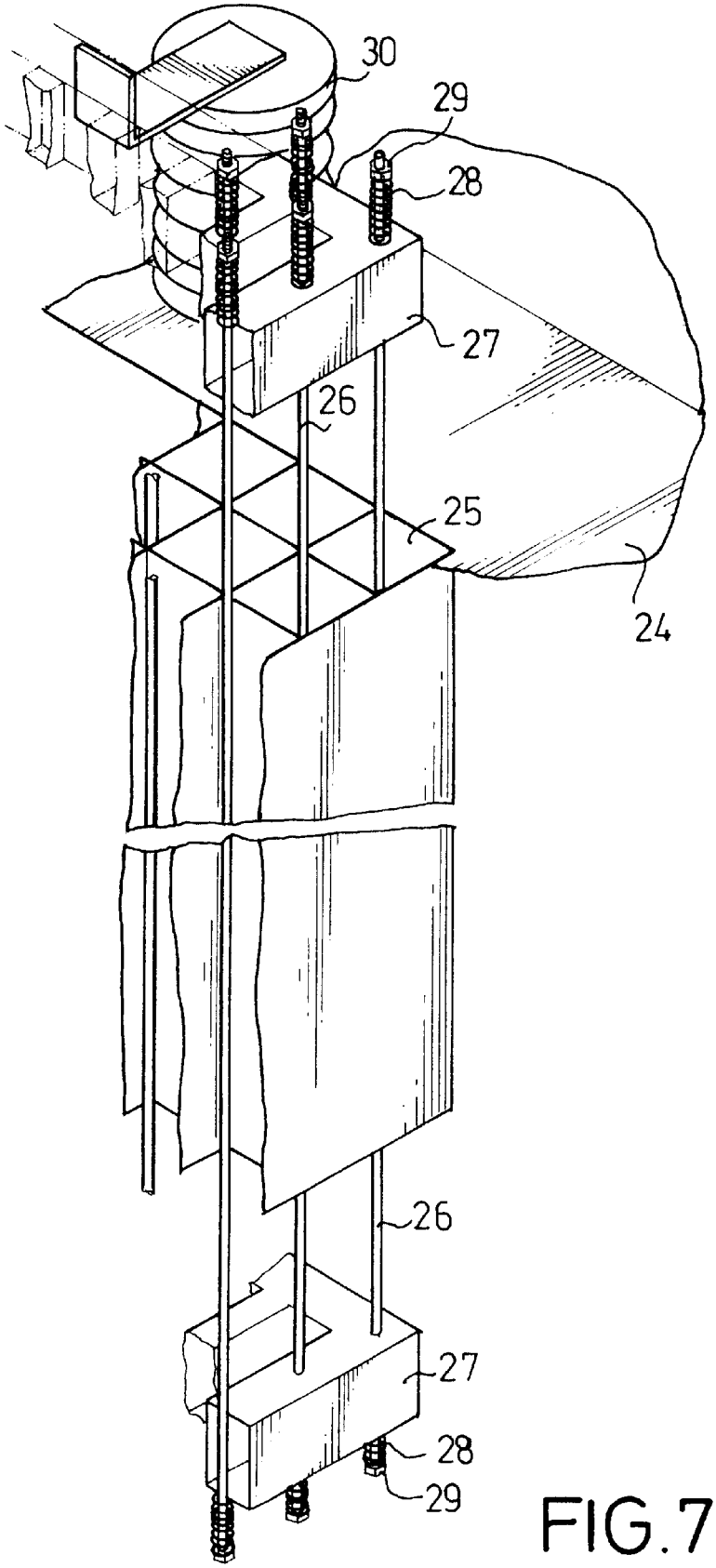
FIG. 7 is fragmentary perspective view showing the internal structure in the middle portion of FIG. 5.

The two spaces within the hollow body are connected in fluid communication with each other by a set of parallel ducts (25) which, preferably with a square cross-section each as shown in FIG. 7, extend vertically between the spaced partitions (24).

Figure 6:
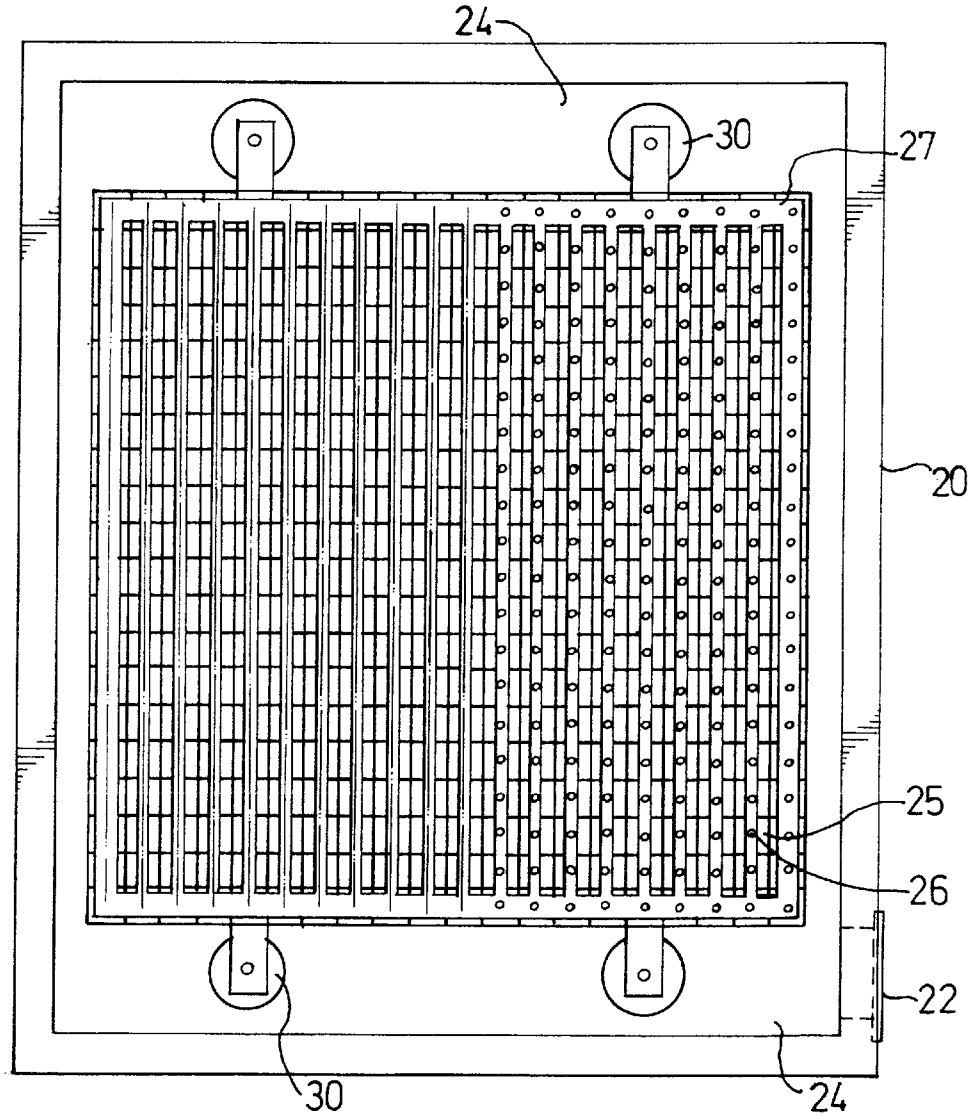
FIG. 6 is a top view of the middle portion of FIG. 5.

Also arranged in the middle portion (20) is a pair of distributor frames (27), one of them over and the other of them under the ducts (25). For example , as shown in FIG. 6, the frames (27) may each have a plurality of parallel bars positioned either over or under respective rows of the ducts (25).

Figure 5:
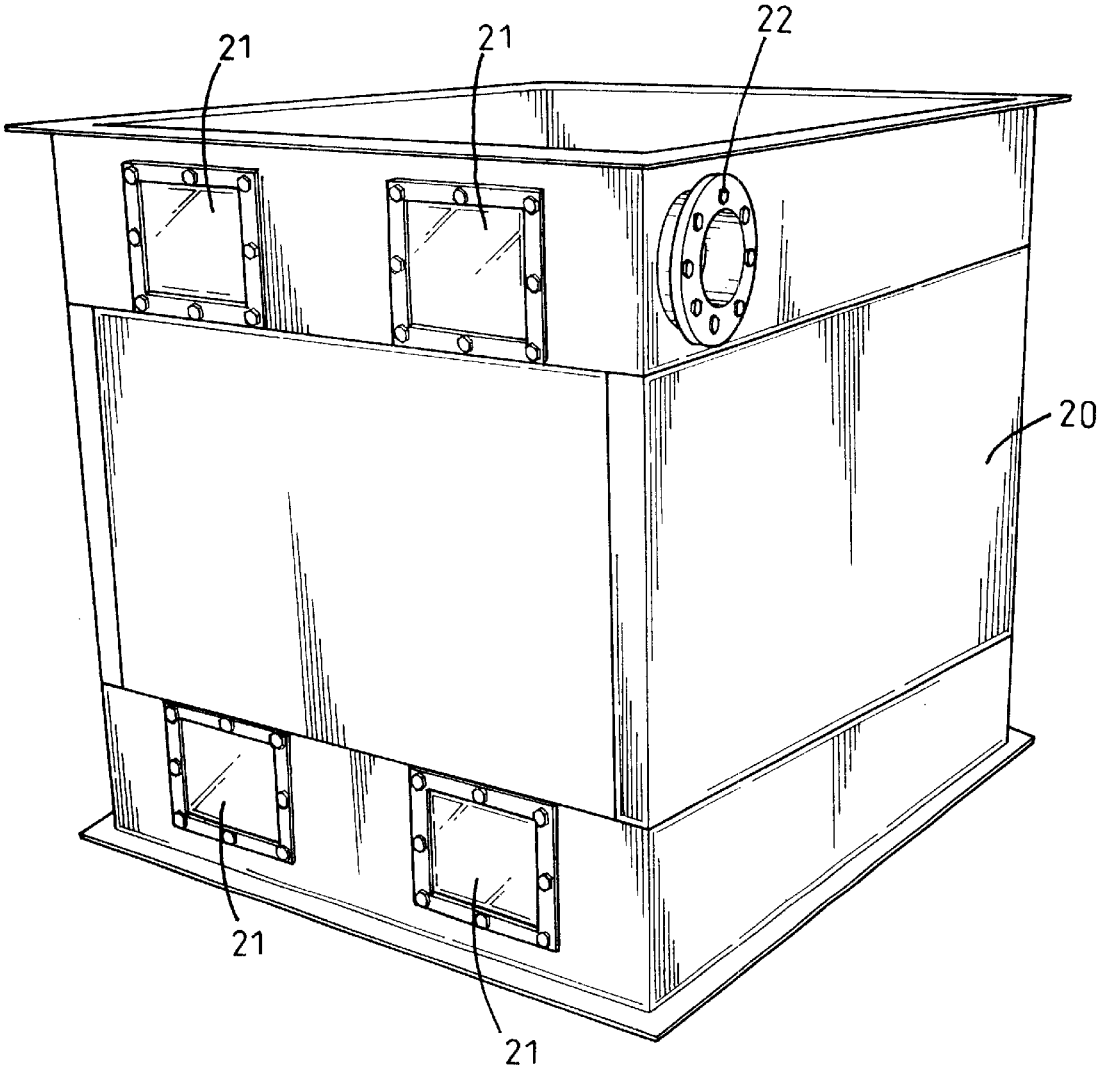
FIG. 5 is a perspective view of a middle portion included in the electrostatic precipitator of FIG. 1.

Referring back to FIGS. 3, and 4 and additionally to FIG. 5, the middle portion (20) of the hollow body is further formed with a plurality of windows (21) in its side walls and an opening (22) in its back wall, preferably with the opening (22) configured as a rim collar, as best shown in FIG. 5.

In the inventive precipitator, each of the distributor frames (27) is further formed with a plurality of terminals (30), which is accessible as soon as the windows (21) are opened.

The terminals (30) can be electrically connected to the positive electrode of a DC high-voltage power supply (23), which is designed to be separate from the hollow body, with a cord that extends through the opening (22) in the middle portion (20). With the same cord, however, the ducts (25) are to be electrically connected to the negative electrode of the DC high-voltage power supply (23).

Referring to FIG. 7, a plurality of wires (26) is electrically connected to the distributor frames (27) and extends through-respective ducts (25). Each of the wires (26) is stretched between the bars of the two spaced distributor frames (27), preferably by a pair of springs (28) each compressed between one distributor frame (27) and a nut (29) that is threaded onto one end of the wire (26).

In this configuration, the wires (26) become high-voltage anodes and the ducts (25) become cathodes when the inventive precipitator is switched on, and so the wires (26) and ducts (25) create respective electric fields between them. If there is smoke passing through the ducts (25), particles in the smoke probably impact the anodes (25) and are positively electrified. These electrified particles then fly in the electric fields to the cathodes, i.e., the ducts (25), where they are accumulated as soot, most of which will finally fall from the walls of the vertically-extending ducts (25).

Clearly, the precipitator purifies smoke more efficiently than any one in the prior art, due to the fact that the wires (26) extend through the full length of the ducts (25).

In the illustrated highly-preferred embodiment, the inventive precipitator further includes a plurality of sprinklers (44), as shown in FIGS. 2 and 4, provided in the top portion (40) to wash away the remaining soot on the elements within the hollow body. Furthermore, as still shown in FIG. 2, the base portion (10) has a tapered bottom (11) and a water outlet (12) that is defined at the bottom (11) to drain the water out of the hollow body.

Figure 8:
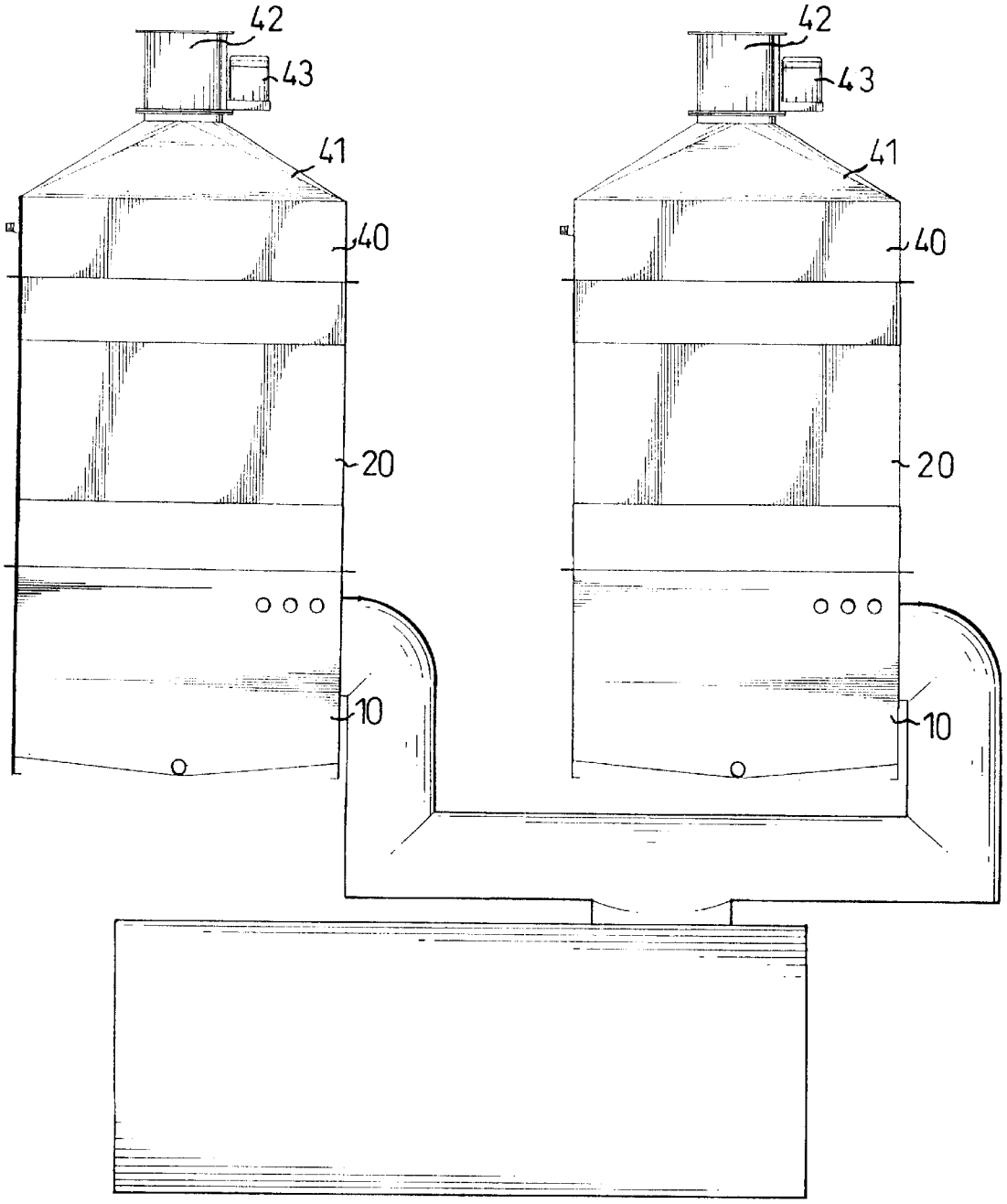
FIG. 8 is schematic view showing a pair of the inventive precipitators being used collectively.
Figure 9:
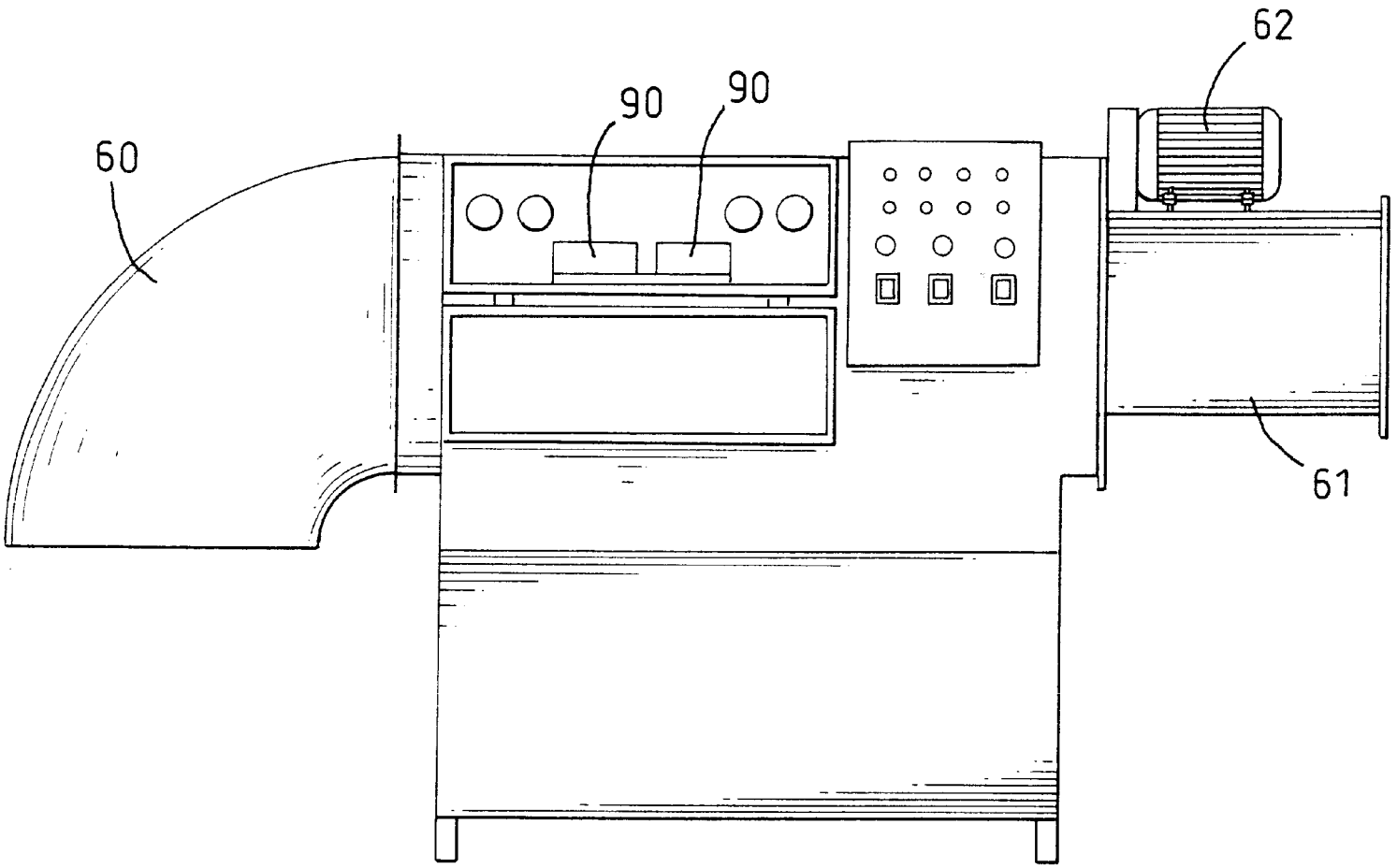
FIG. 9 PRIOR ART
FIG. 9 is a front view of a conventional electrostatic precipitator.
Figure 10:
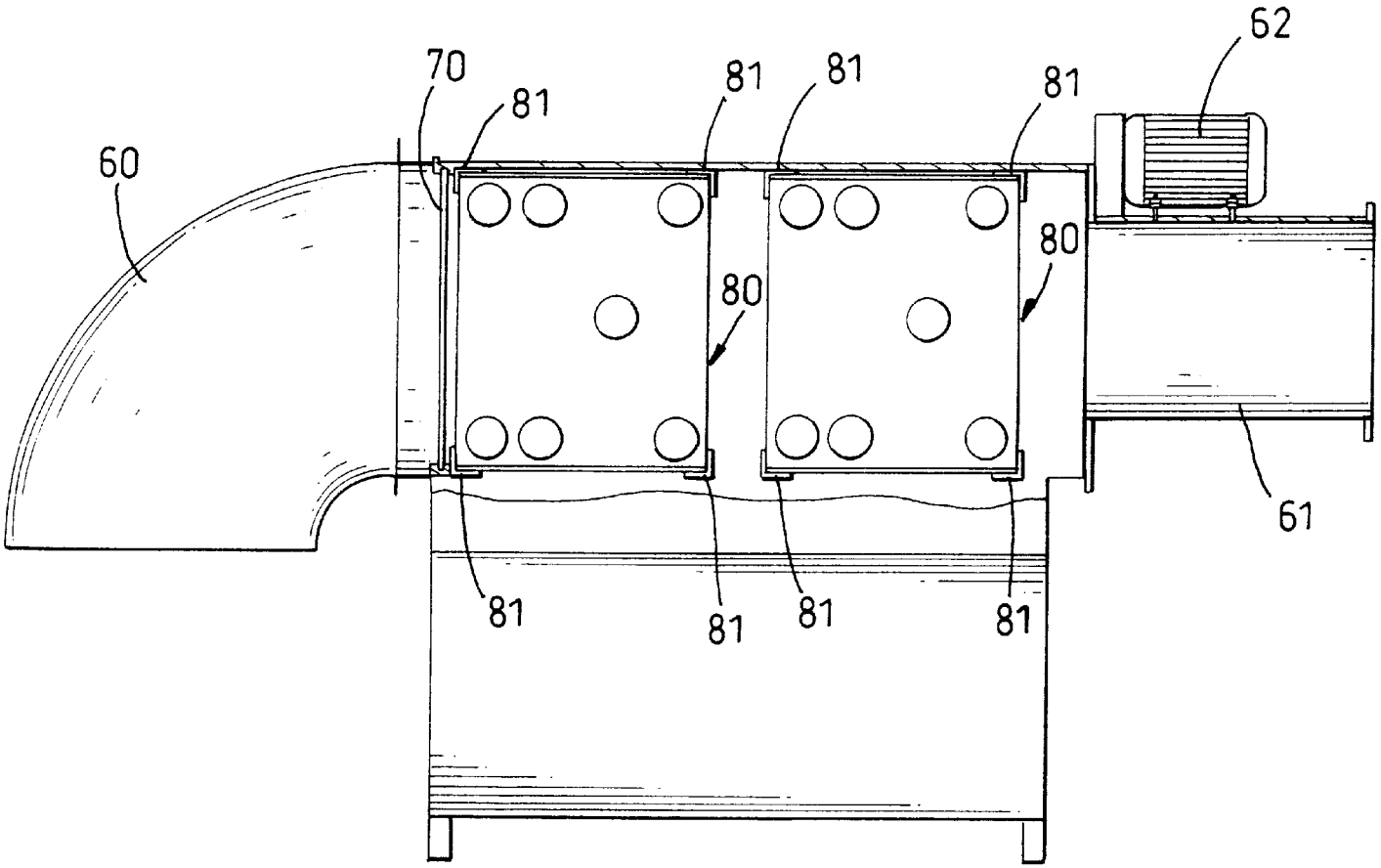
FIG. 10 PRIOR ART
FIG. 10 is a front view, partially broken, of the conventional electrostatic precipitator of FIG. 9.
Figure 11:
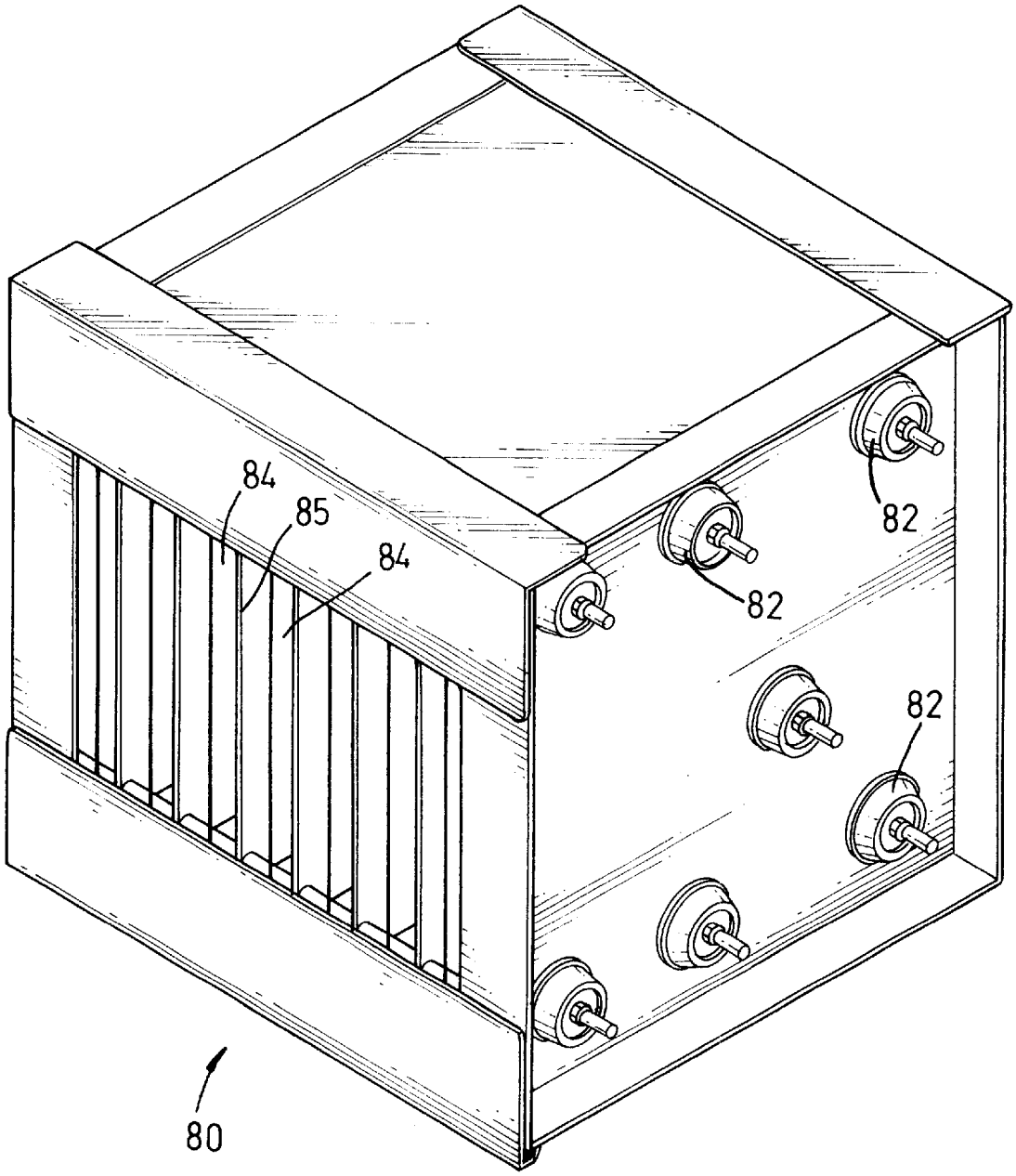
FIG. 11 PRIOR ART
FIG. 11 is a perspective view of a collecting box included in the conventional electrostatic precipitator of FIG. 9.

Referring to FIG. 8, two or more electrostatic precipitators of this inventive type might be used collectively, in a manner of being electrically connected either in parallel or in series and being supplied with energy from the same DC high-voltage power supply (23). Indeed, the separate power supply (23) facilitates such collection of the electrostatic precipitators.

From the above description, it is noted that the invention has the following advantages:

1. improved efficiency in purification of smoke:
   Because the wires (26) extend through the full length of the ducts (25), more particles in the smoke will impact them and be captured by the electrostatic precipitator, and so the efficiency in purification is improved.
2. requiring a small area on the ground:
   Because of the upright configuration of the hollow body, the inventive precipitator cove a less area on the ground than the prior art.
3. self-cleaning for the electrodes:
   Because of the vertical arrangement of the ducts (25), most of the particles collected on the walls of the ducts (25) will finally fall by themselves as a way of self-cleaning for the cathode electrodes.
4. easy maintenance for the terminals (30) of the distributor frames (27):
   Because of the windows (21), the terminals (30) can be repaired or cleaned as soon as the windows (21) are opened.
5. being easy to be cleaned:
   Because of the sprinklers (44) provided in the precipitator, elements in the hollow body can be cleaned without removing them therefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrostatic precipitator comprising:

an upright hollow body having a lower smoke inlet (13) and an upper smoke outlet (42), said hollow body having a pair of spaced horizontal partitions (24) arranged therein between said lower inlet (13) and said upper outlet (42);

said partitions (24) being arranged to divide the room within said hollow body into an upper space above said partitions (24) and a lower space below said partitions (24);

a set of parallel ducts (25) extending vertically between said partitions (24) and connecting said upper and lower spaces to each other;

a pair of distributor frames (27) arranged in said hollow body, one of said distributor frames (27) being disposed over said ducts (25) and the other of said distributor frames (27) being disposed under said ducts (25);

a plurality of wires (26) each electrically connected to and stretched between said distributor frames (27) and extending through corresponding one of said ducts (25); and wherein each of said distributor frames (27) is formed with a plurality of terminals (30) to be electrically connected to one electrode of a DC high-voltage power supply, and said ducts (25) are adapted to be electrically connected to the other electrode of said DC high-voltage power supply.

2. The electrostatic precipitator as claimed in claim 1, wherein said hollow body includes a base portion (10), a middle portion (20) and a top portion (40) arranged in a stack, and wherein said middle portion (20) is formed with said partitions (24), said ducts (25), said distributor frames (27) and said wires (26).

3. The electrostatic precipitator as claimed in claim 2, wherein said top portion (40) of said hollow body is provided with an extractor fan in said outlet (42) and with a motor (43) for driving said fan.

4. The electrostatic precipitator as claimed in claim 2, wherein each of said portions (10, 20, 40) of said hollow body is made of metal.

5. The electrostatic precipitator as claimed in claim 4, wherein each of said base portion (10) and said middle portion (20) of said hollow body has a rectangular cross-section.

6. The electrostatic precipitator as claimed in claim 5, wherein said middle portion (20) of said hollow body is formed with a plurality of windows (21) from which said terminals (30) of said distributor frames (27) are accessible.

7. The electrostatic precipitator as claimed in claim 6, wherein said middle portion (20) of said hollow body is further formed with an opening (22) through which a cord may extend to electrically connect said terminals (30) and said ducts (25) to said electrodes of said DC high-voltage power supply.

8. The electrostatic precipitator as claimed in claim 7, wherein said top portion (40) is provided with at least one sprinkler (44) therein, and wherein said base portion (10) has a tapered bottom (11) and a water outlet (12) defined at said bottom (11).

* * * * *